US008039534B2

(12) United States Patent
Tsuge et al.

(10) Patent No.: US 8,039,534 B2
(45) Date of Patent: Oct. 18, 2011

(54) FLAME-RETARDER AGENT FOR POLYESTER-BASED FIBER, FLAME RETARDANT POLYESTER-BASED FIBER USING THE SAME AND METHOD FOR PRODUCING THE SAME

(75) Inventors: Yoshiki Tsuge, Fukui (JP); Junichi Hosokawa, Fukui (JP)

(73) Assignee: Nicca Chemical Co., Ltd., Fukui-shi, Fukui (JP)

( * ) Notice: Subject to any disclaimer, the term of this patent is extended or adjusted under 35 U.S.C. 154(b) by 0 days.

(21) Appl. No.: 12/745,328

(22) PCT Filed: Mar. 25, 2009

(86) PCT No.: PCT/JP2009/055945

§ 371 (c)(1),
(2), (4) Date: May 28, 2010

(87) PCT Pub. No.: WO2009/122980

PCT Pub. Date: Oct. 8, 2009

(65) Prior Publication Data

US 2010/0311878 A1 Dec. 9, 2010

(30) Foreign Application Priority Data

Mar. 31, 2008 (JP) ..... 2008-089360

(51) Int. Cl.
*C08K 5/5397* (2006.01)
*C08K 5/523* (2006.01)

(52) U.S. Cl. ..... 524/139; 524/141; 524/143; 524/145

(58) Field of Classification Search ..... 524/139, 524/141, 143, 145
See application file for complete search history.

(56) References Cited

U.S. PATENT DOCUMENTS 5,969,016 A * 10/1999 Weber et al. ..... 524/127
6,124,385 A * 9/2000 Honl et al. ..... 524/115

FOREIGN PATENT DOCUMENTS

| | | | |
|---|---|---|---|
| JP | 2000-328445 | A | 11/2000 |
| JP | 2002-294554 | A | 10/2002 |
| JP | 2003-193368 | A | 7/2003 |
| JP | 2004-225176 | A | 8/2004 |
| JP | 2007-92263 | A | 4/2007 |
| JP | 2007-092263 | A | 4/2007 |
| WO | 2008/047897 | A1 | 4/2008 |
| WO | WO 2008/047897 | A1 | 4/2008 |

OTHER PUBLICATIONS

English translation of International Search Report issued on May 12, 2009 in International Application No. PCT/JP2009/055945.
PCT International Preliminary Report on Patentability in PCT/JP2009/055945 dated Dec. 13, 2010.
PCT Written Opinion of the International Searching Authority in PCT/JP2009/055945 (English translation).

* cited by examiner

*Primary Examiner* — Peter Szekely
(74) *Attorney, Agent, or Firm* — Fitch, Even, Tabin & Flannery

(57) ABSTRACT

A flame-retarder agent for a polyester-based fiber comprising, as flame-retarder components:

triphenylphosphine oxide (A) represented by the following formula (1):

(1)

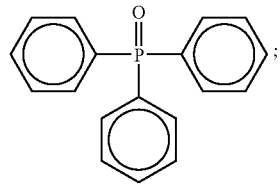

and at least one compound (B) selected from the group consisting of an organophosphate ester-based compound ($B_1$) and a bismaleimide-based compound ($B_2$), the organophosphate ester-based compound ($B_1$) being represented by the following general formula (2):

(2)

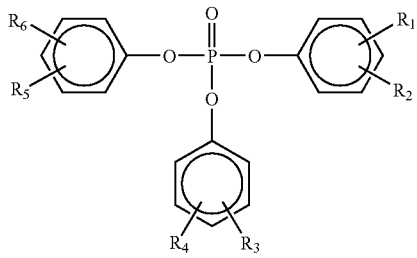

[in formula (2), $R_1$ to $R_6$ each represent one selected from the group consisting of a hydrogen atom and an alkyl group having 1 to 4 carbon atoms], and the bismaleimide-based compound ($B_2$) being represented by the following general formula (3):

(3)

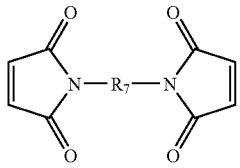

[in formula (3), $R_7$ represents an arylene group having 6 to 20 carbon atoms].

8 Claims, No Drawings

FLAME-RETARDER AGENT FOR POLYESTER-BASED FIBER, FLAME RETARDANT POLYESTER-BASED FIBER USING THE SAME AND METHOD FOR PRODUCING THE SAME

CROSS-REFERENCE TO RELATED APPLICATIONS

This application is a U.S. National Phase entry of International Application No. PCT/JP2009/055945, filed Mar. 25, 2009, which claims foreign priority to Japanese Patent Application No. 2008-089360, filed Mar. 31, 2008. The complete disclosures of the referenced applications are incorporated herein by reference.

TECHNICAL FIELD

The present invention relates to a flame-retarder agent for a polyester-based fiber, a method for producing a flame retardant polyester-based fiber by use of the flame-retarder agent, and the flame retardant polyester-based fiber.

BACKGROUND OF THE INVENTION

Conventionally, as methods for providing a polyester-based fiber with flame retardancy, a method has been known which employs a halogenated cycloalkane compound, such as hexabromocyclododecane, as a flame-retarder component, and which uses a flame-retarder agent obtained by dispersing the flame-retarder component in water by a dispersant.

However, recent increasing concerns over global and living environment protection have led to development of methods for providing a polyester-based fiber with flame retardancy by using as a flame-retarder component a phosphorus-containing compound, which contains no halogen atom, instead of a halogen-containing compound. For example, Japanese Unexamined Patent Application Publication No. 2000-328445 (Document 1) discloses a flame-retardant processing method in which a flame-retarder agent containing resorcinol bis (diphenyl phosphate) emulsified and dispersed in the presence of a surfactant is added to a dyeing liquid and is adsorbed to a polyester-based fiber at the same time of dyeing. Meanwhile, Japanese Unexamined Patent Application Publication No. 2003-193368 (Document 2) discloses a flame-retardant processing method in which: a flame-retarder agent containing an aryl diamino phosphate, such as 1,4-piperazinediyl bis(diaryl phosphate), dispersed in a solvent in the presence of a surfactant is added to a dyeing liquid; the flame-retarder agent is adsorbed to a polyester-based fiber at the same time of dyeing; and the polyester-based fiber is dried and then heat-treated at 170° C. to 220° C. Document 2 also discloses a flame-retardant processing method in which: a polyester-based fiber is dyed; the flame-retarder agent is adhered to polyester-based fiber; and then the polyester-based fiber is dried and heat-treated at 170° C. to 220° C.

However, the flame-retardant processing methods described in Document 1 and Document 2 have difficulty in making the phosphorus flame-retarder component sufficiently absorbed to the polyester-based fiber, which leads to a problem that sufficient flame retardancy cannot be provided to the polyester-based fiber. These methods also have a problem that, owing to ultraviolet light or the like, the phosphamide in the polyester-based fiber causes degradation of the dye in the polyester-based fiber and in turn discoloration thereof.

In addition, phosphate ester-based flame-retarder agents generally have problems such as impacts on fogging properties (haze properties), hydrolytic properties, thermal stability, and dye-affinity; and decrease in light fastness and rubbing fastness. These problems are crucial especially when such flame-retarder agents are used for interior materials for vehicle. For this reason, as a phosphorus flame-retarder agent which can alleviate these problems to a relatively large extent, for example, Japanese Unexamined Patent Application Publication No. 2007-092263 (Document 3) discloses a flame-retarder agent in which triphenylphosphine oxide is used as a flame-retarder component. However, even with the flame-retarder agent disclosed in Document 3, the amount of the triphenylphosphine oxide absorbed into a polyester-based fiber is small, resulting in a problem that sufficient flame retardancy cannot be provided to the polyester-based fiber.

DISCLOSURE OF THE INVENTION

The present invention has been made in consideration of the above-described problems of the conventional techniques. An object of the present invention is to provide a phosphorus flame-retarder agent which is capable of providing an excellent flame retardancy to a polyester-based fiber while adverse impacts on light fastness, rubbing fastness and fogging properties (haze properties) are sufficiently prevented, and which is excellent in thermal stability and hydrolysis resistance, and also to provide a polyester-based fiber having an excellent flame retardancy, and a method for producing the polyester-based fiber.

As a result of earnest study for achieving the above object, the inventors have found that a polyester-based fiber having an excellent flame retardancy can be obtained by using triphenylphosphine oxide and a specific organophosphate ester-based compound and/or a specific bismaleimide-based compound as flame-retarder components, while adverse impacts on fogging properties (haze properties), light fastness and rubbing fastness are sufficiently prevented. This discovery has led the inventors to the completion of the present invention.

A flame-retarder agent for a polyester-based fiber of the present invention comprises, as flame-retarder components:

triphenylphosphine oxide (A) represented by the following formula (1):

[Chemical formula 1]

(1)

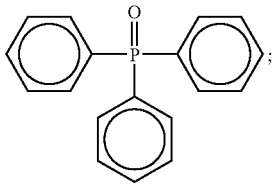

and at least one compound (B) selected from the group consisting of an organophosphate ester-based compound ($B_1$) and a bismaleimide-based compound ($B_2$), the organophosphate ester-based compound ($B_1$) being represented by the following general formula (2):

[Chemical formula 2]

(2)

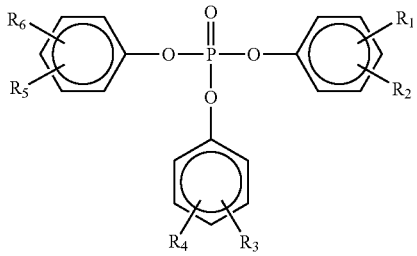

[in formula (2), $R_1$ to $R_6$ are the same or different, and each represent one selected from the group consisting of a hydrogen atom and an alkyl group having 1 to 4 carbon atoms], the bismaleimide-based compound ($B_2$) being represented by the following general formula (3):

[Chemical formula 3]

(3)

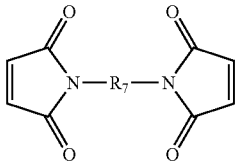

[in formula (3), $R_7$ represents an arylene group having 6 to 20 carbon atoms].

In the flame-retarder agent for a polyester-based fiber of the present invention, a ratio (A:B) by mass of the triphenylphosphine oxide (A) to the compound (B) is 1:0.05 to 1:0.8.

Meanwhile, the organophosphate ester-based compound ($B_1$) is preferably cresyl diphenyl phosphate, and the bismaleimide-based compound ($B_2$) is preferably phenylene bismaleimide.

Furthermore, in the flame-retarder agent for a polyester-based fiber of the present invention, the triphenylphosphine oxide (A) and the compound (B) are preferably emulsified or dispersed in water (D) by a surfactant (C). In this case, the surfactant (C) is preferably a phosphate ester anionic surfactant.

A flame retardant polyester-based fiber comprises:

a polyester-based fiber; and triphenylphosphine oxide (A) represented by the formula (1) and at least one compound (B) which are fixed to the polyester-based fiber as flame-retarder components, the at least one compound (B) being selected from the group consisting of an organophosphate ester-based compound ($B_1$) represented by the general formula (2) and a bismaleimide-based compound ($B_2$) represented by the general formula (3).

Meanwhile, a method for producing a flame retardant polyester-based fiber of the present invention comprises the steps of: bringing the flame-retarder agent of the present invention into contact with a polyester-based fiber; and fixing the triphenylphosphine oxide (A) and the compound (B) to the polyester-based fiber by heating.

The present invention makes it possible to provide a phosphorus flame-retarder agent which is capable of providing an excellent flame retardancy to a polyester-based fiber while adverse impacts on light fastness, rubbing fastness and fogging properties (haze properties) are sufficiently prevented, and which is excellent in thermal stability and hydrolysis resistance, and also to provide a polyester-based fiber having an excellent flame retardancy, and a method for producing the polyester-based fiber.

Moreover, the flame-retarder agent for a polyester-based fiber of the present invention contains no halogen atoms. Thus, when the flame retardant polyester-based fiber of the present invention obtained by using the flame-retarder agent is, for example, disposed of by incineration, generation of dioxins attributable to the flame-retarder agent is sufficiently prevented. Thus, the flame-retarder agent is preferable in terms of environmental protection and ecology.

DETAILED DESCRIPTION OF THE PREFERRED EMBODIMENTS

Hereinafter, the present invention will be described in detail with reference to preferred embodiments thereof. First, description will be given of a flame-retarder agent for a polyester-based fiber of the present invention.

The flame-retarder agent for a polyester-based fiber of the present invention includes, as flame-retarder components: triphenylphosphine oxide (A); and at least one compound (B) selected from the group consisting of a specific organophosphate ester-based compound ($B_1$) and a specific bismaleimide-based compound ($B_2$) which are to be described below in detail.

Triphenylphosphine oxide (A) according to the present invention is a compound represented by the following formula (1). Note that the triphenylphosphine oxide (A) according to the present invention may contain triphenylphosphine and the like as impurities, as long as the impurities do not impair the effects of the present invention.

[Chemical formula 4]

(1)

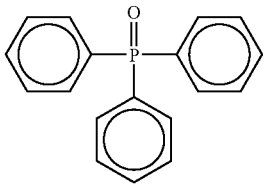

The organophosphate ester-based compound ($B_1$) according to the present invention is a compound represented by the following general formula (2):

[Chemical formula 5]

(2)

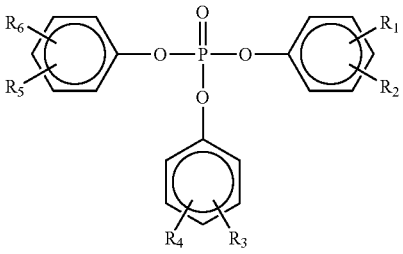

In general formula (2), $R_1$ to $R_6$ may be the same or different and each represent one selected from the group consisting of a hydrogen atom and an alkyl group having 1 to 4 carbon atoms. Examples of such an organophosphate ester-based compound ($B_1$) include trixylyl phosphate, triphenyl phosphate, tricresyl phosphate (tritolyl phosphate), tolyl diphenyl phosphate, tricumenyl phosphate, and cresyl diphenyl phosphate. Of these, cresyl diphenyl phosphate is particularly preferable from the view point of further improving flame retardancy provided to a polyester-based fiber.

The bismaleimide-based compound ($B_2$) according to the present invention is a compound represented by the following general formula (3).

[Chemical formula 6]

(3)

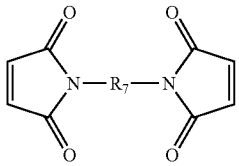

In general formula (3), $R_7$ represents an arylene group having 6 to 20 carbon atoms. Examples of such an arylene group having 6 to 20 carbon atoms include phenylene, methylene bisphenylene, methylphenylene, dimethylmethylene bisphenylene, sulfone bisphenylene, ethylphenylene, butylphenylene, ethylene bisphenylene, butylene bisphenylene, and methylene bisphenylene. Examples of such a bismaleimide-based compound ($B_2$) include 4,4'-diphenylmethane bismaleimide, phenylene bismaleimide, 4-methyl-1,3-phenylene bismaleimide. Of these, phenylene bismaleimide is particularly preferable from the view point of further improving the flame retardancy provided to a polyester-based fiber.

The blend ratio by mass of the flame-retarder components in the flame-retarder agent of the present invention, that is, the triphenylphosphine oxide (A) and the compound (B) {the organophosphate ester-based compound ($B_1$)) and/or the bismaleimide-based compound ($B_2$)} is preferably 1:0.05 to 1:0.8, and more preferably 1:0.3 to 1:0.6, in terms of (mass of A):(total mass of B). If the blend ratio of the compound (B) is lower than the above-described lower limit, it tends to be difficult to provide sufficient flame retardancy to the polyester-based fiber while adverse impacts on light fastness, and fogging properties are sufficiently prevented. On the other hand, if the blend ratio of the compound (B) exceeds the above-described upper limit, it also tends to be difficult to provide sufficient flame retardancy to the polyester-based fiber while adverse impacts on light fastness, and fogging properties are sufficiently prevented.

Here, any one of the organophosphate ester-based compound ($B_1$) and the bismaleimide-based compound ($B_2$) may be used as the compound (B). However, from the view point of tendency that a higher flame retardancy can be provided to the polyester-based fiber while adverse impacts on light fastness and fogging properties are further sufficiently prevented, it is preferable to use both the organophosphate ester-based compound ($B_1$) and the bismaleimide-based compound ($B_2$). In this case, the blend ratio by mass between the triphenylphosphine oxide (A), the organophosphate ester-based compound ($B_1$) and the bismaleimide-based compound ($B_2$) is preferably 1:0.03:0.02 to 1:0.6:0.2, and more preferably 1:0.2:0.1 to 1:0.45:0.15, in terms of (mass of A):(mass of $B_1$):(mass of $B_2$).

The flame-retarder agent for a polyester-based fiber of the present invention only needs to contain the flame-retarder components, and a solvent used is not particularly limited; however, water is preferably used in consideration of the environment or from other viewpoints. In such a case, the flame-retarder components are preferably emulsified or dispersed in water (D), and a surfactant (C) is more preferably used for emulsifying or dispersing the flame-retarder components.

Examples of such a surfactant include a nonionic surfactant, and an anionic surfactant. Such a nonionic surfactant is not particularly limited, and examples thereof include a polyoxyalkylene ether, a polyoxyalkylene alkyl ether, a polyoxyalkylene aryl ether, and a polyoxyalkylene alkyl polyvalent alcohol ether.

In addition, such an anionic surfactant is not particularly limited, and examples thereof include sulfate salts such as an alkylbenzenesulfonate salts, an α-olefin sulfonate salts, a polyoxyalkylene ether sulfate salts, a polyoxyalkylene alkyl ether sulfate salts, a polyoxyalkylene aryl ether sulfate salts, a polyoxyalkylene alkyl polyvalent alcohol ether sulfate salts, and an alcohol sulfate salts; and phosphate esters such as a polyoxyalkylene ether phosphate ester, a polyoxyalkylene alkyl ether phosphate ester, a polyoxyalkylene aryl ether phosphate ester, a polyoxyalkylene alkyl polyvalent alcohol ether phosphate ester, and an alcohol phosphate ester, and salts thereof. Of these, phosphate ester surfactants, such as phosphate esters, for example, a polyoxyalkylene ether phosphate ester, a polyoxyalkylene alkyl ether phosphate ester, a polyoxyalkylene aryl ether phosphate ester, a polyoxyalkylene alkyl polyvalent alcohol ether phosphate ester, and an alcohol phosphate ester; and salts thereof are preferable from the view points of dispersibility and thermal stability, and a polyoxyalkylene aryl ether phosphate ester is particularly preferable. Examples of the above-described salts include alkali metal salts and amine salts. Examples of the alkali metal salts include salts of lithium, sodium and potassium. Examples of the amine salts include salts of primary amines such as ammonia, methylamine, ethylamine, propylamine, butylamine, and allylamine; salts of secondary amines such as dimethylamine, diethylamine, dipropylamine, dibutylamine, and diallylamine; salts of tertiary amines such as trimethylamine, triethylamine, tripropylamine, and tributylamine; and salts of alkanolamines such as monoethanolamine, diethanolamine, and triethanolamine. These nonionic surfactants and anionic surfactants may be used as one kind alone or as a mixture of two or more kinds.

The amount of these surfactants used is not particularly limited; however, the amount is preferably about 1 to 50 parts by mass, and more preferably about 1 to 30 parts by mass, per 100 parts by mass of the total amount of the above-described flame-retarder components. If the amount of these surfactants used is lower than the above-described lower limit, the obtained flame-retarder agent tends to have an unacceptable emulsion stability. On the other hand, if the amount of these surfactants used exceeds the above-described upper limit, the amount of the flame-retarder components attached to the polyester-based fiber decreases, so that the flame retardancy tends to decrease.

Meanwhile, the contained amount of the flame-retarder components in the flame-retarder agent of the present invention is not particularly limited; however, the amount is preferably about 20 to 90% by mass, and more preferably about 25 to 60% by mass, relative to the total mass of the flame-retarder agent. If the contained amount of such flame-retarder components is lower than the above-described lower limit, there arises a tendency that flame retardancy good enough to satisfy durability requirements is less likely to be obtained, unless more amount of the flame-retarder agent is used in the treatment. On the other hand, if the contained amount of the flame-retarder components exceeds the above-described upper limit, there arises a tendency that obtaining the flame-retarder agent as a liquid becomes difficult, and thereby handling thereof becomes difficult. Note that, as will be described later, the flame-retarder agent of the present invention can be used as it is or after appropriate dilution in accordance with, for example, a coating method employed in performing a flame retardant treatment on the polyester-based fiber.

Meanwhile, a method of emulsifying or dispersing the flame-retarder components is not particularly limited in the present invention. Examples of the emulsifying method include a method for phase inversion emulsification by using a homomixer. On the other hand, examples of the dispersing method include a wet dispersion method with a bead mill using glass beads.

Furthermore, the average particle diameter in the emulsion or dispersion of the flame-retarder components in the flame-retarder agent of the present invention is preferably 0.01 to 1 μm. If the average particle diameter in the emulsion or dispersion exceeds the above-described upper limit, an effect to stably maintain a sufficient flame retardancy tends to decrease.

Note that the flame-retarder agent of the present invention may be an emulsion or a dispersion of the above-described triphenylphosphine oxide (A) and the above-described compound (B) mixed therein. Alternatively, the flame-retarder agent of the present invention may be a kit including: an emulsion or a dispersion containing the triphenylphosphine oxide (A); and an emulsion or a dispersion containing the compound (B).

Next, a method for producing a flame retardant polyester-based fiber of the present invention will be described.

The flame-retardant processing method of a polyester-based fiber of the present invention includes the steps of: bringing the above-mentioned flame-retarder agent of the present invention into contact with a polyester-based fiber; and fixing the triphenylphosphine oxide (A) and the compound (B) to the polyester-based fiber by heating.

The polyester-based fiber used in the present invention is not particularly limited; however, examples thereof include a regular polyester fiber, a cationic dyeable polyester fiber, a recycled polyester fiber, and a polyester fiber formed of two or more kinds thereof. In addition, as the polyester-based fiber, a composite fiber obtained by spinning a mixture of such a polyester fiber with: a natural fiber such as cotton, hemp, silk or wool; a semi synthetic fiber such as rayon or acetate; a synthetic fiber such as nylon, acrylic or polyamide; an inorganic fiber such as a carbon fiber, a glass fiber, a ceramic fiber, or a metal fiber; or a fiber formed of two or more kinds thereof can be used. Furthermore, the form of the polyester-based fiber used in the present invention is not particularly limited, and may be any form of a yarn, a tow, a top, a skein, a woven fabric, a textile, a non-woven fabric, a rope or the like.

First, description will be given of the step of bringing the above-described flame-retarder agent into contact with the polyester-based fiber. This step is a method for bringing the flame-retarder agent into contact with the polyester-based fiber which is a material to be treated, and thereby attaching the flame-retarder agent to the polyester-based fiber. The flame-retarder agent can be brought into contact with the polyester-based fiber, for example, by a method such as an immersion method, a padding method, a spray method, or an application method (a coating method or a printing method).

Note that, when used as the flame-retarder agent of the present invention, an emulsion or a dispersion in which the triphenylphosphine oxide (A) and the compound (B) are mixed is used as it is or after appropriate dilution as a treatment liquid. Meanwhile, when a kit of an emulsion or a dispersion containing the triphenylphosphine oxide (A) and an emulsion or a dispersion containing the compound (B) is used as the flame-retarder agent of the present invention, it is preferable to mix, in advance, the flame-retarder agent, and then use the mixture as a treatment liquid; however, emulsions or dispersions of the triphenylphosphine oxide (A) and the compound (B) may be separately used as treatment liquids, and sequentially (the order may be any of A→B and B→A) or simultaneously brought into contact with the polyester-based fiber.

In the case of using the immersion method, the flame-retarder agent can be attached to the polyester-based fiber by immersing the polyester-based fiber into a treatment liquid containing the flame-retarder agent. In addition, dyeing process and the step of attaching the flame-retarder agent to the polyester-based fiber can be conducted simultaneously by using the flame-retarder agent and a dispersion dye or a fluorescent dye at the same time. In this case, a liquid flow dyeing machine, a beam dyeing machine, and a cheese dyeing machine can be used, for example.

When the coating method is employed, the flame-retarder agent whose viscosity is adjusted to an appropriate level for the treatment may be used, or a foam processing coating method may be used in which such a liquid containing the flame-retarder agent is made foamy and then attached to the polyester-based fiber. With such a foam processing coating, a necessary amount of a formed liquid containing the flame-retarder agent can be attached to the polyester-based fiber. Accordingly, the energy and time required for drying are greatly reduced, and the flame-retarder agent can be used without waste. A viscosity modifier for adjusting the viscosity to a degree suitable for processing is not particularly limited, and examples thereof include polyvinyl alcohol, methyl cellulose, propyl cellulose, carboxymethyl cellulose, hydroxyethyl cellulose, xanthan gum, gelatinized starch and the like. In this case, an air doctor coater, a blade coater, a rod coater, a knife coater, a squeeze coater, a reverse roll coater, a transfer coater, a gravure coater, a kiss roll coater, a cast coater, a curtain coater and calendar coater can be used, for example.

Meanwhile, when the spray method is employed, an air spray with which a treatment liquid containing the flame-retarder agent is mist-sprayed by using compressed air, and an air spray which uses liquid pressure for atomization can be used, for example. In addition, when the printing method is employed, a roller printer, a flat screen printer, and a rotary screen printer can be used, for example.

Next, description will be given of the step of fixing the flame-retarder components to the polyester-based fiber by heating. This step is a heat treatment step of heat-treating the polyester-based fiber with the flame-retarder agent attached thereto, thereby fixing (causing) the flame-retarder components to (to be absorbed by) the polyester-based fiber. The heat treatment step may be conducted after the step (attachment step) for attachment of the flame-retarder agent is conducted. Alternatively, the attachment step and the heat treatment step may be conducted simultaneously.

Note that, when such a heat treatment step is performed after the attachment step is conducted, the polyester-based fiber with the flame-retarder agent attached thereto can be heat-treated by a dry heating treatment or a steam heat treatment such as a normal-pressure saturated-steam treatment, a heated steam treatment, and a high pressure steam treatment. In such a heat treatment, the heat treatment temperature is preferably in the range of 110° C. to 210° C., and more preferably in the range of 160° C. to 210° C. If the heat treatment temperature is lower than the above-described lower limit, the flame-retarder components are insufficiently fixed to the polyester-based fiber, and thereby the flame retardancy thereof tends to be insufficient because of the separation of the flame-retarder components in a subsequent step. On the other hand, if the heat treatment temperature exceeds the above-described upper limit, the polyester-based fiber tend to discolor or to become brittle. In such a heat treatment, the treatment time is preferably in the range of 10 seconds to 10 minutes. If the heat treatment time is shorter than the above-described lower limit, the flame-retarder components are insufficiently fixed to the polyester-based fiber, and thereby the flame retardancy thereof tends to be insufficient because of the separation of the flame-retarder components in a subsequent step. On the other hand, if the heat treatment time exceeds the above-described upper limit, the polyester-based fiber tends to discolor or to become brittle.

The polyester-based fiber with the flame-retarder agent attached thereto may be subjected to an in-bath heat treatment in a bath. The in-bath heat treatment represents a treatment in which the flame-retarder components are fixed (absorbed) to the polyester-based fiber in a dyeing bath or a bath containing no dye. In such an in-bath heat treatment, the heat treatment temperature is preferably in the range of 90° C. to 150° C., and more preferably in the range of 110° C. to 140° C. If the heat treatment temperature in the bath is lower than the above-described lower limit, the flame-retarder components tend to be insufficiently absorbed, resulting in an insufficient flame retardancy. On the other hand, if the heat treatment temperature in the bath exceeds the upper limit, the polyester-based fiber tends to change or to become brittle. For such an in-bath heat treatment, the treatment time is preferably in the range of 10 minutes to 60 minutes. If the heat treatment time is shorter than the above-described lower limit, the flame-retarder components are insufficiently absorbed by the polyester-based fiber, and thereby the flame retardancy thereof tends to be insufficient because of the separation of the flame-retarder components in a subsequent step. On the other hand, if the heat treatment time exceeds the above-described upper limit, the polyester-based fiber is more likely to become brittle. In addition, for such an in-bath heat treatment, a liquid flow dyeing machine, a beam dyeing machine, and a cheese dyeing machine can be used, for example. The above-mentioned dry heat treatment or steam heat treatment and the above-mentioned in-bath heat treatment can be conducted in combination. By conducting these treatments in combination, the flame-retarder components tend to be more certainly absorbed by the polyester-based fiber, making it possible to obtain a flame retardant polyester-based fiber having a more excellent durability.

Meanwhile, when such a heat treatment step and the attachment step are simultaneously conduced, the heat treatment can be performed while the polyester-based fiber is being immersed into a treatment liquid containing the flame-retarder agent for attaching the flame-retarder agent to the polyester-based fiber, or while dyeing and the attachment of the flame-retarder agent are being simultaneously conducted by using the flame-retarder agent and a dispersion dye or a fluorescent dye at the same time. The conditions (the treatment temperature and the treatment time) for such a heat treatment may be the same as those for the in-bath heat treatment.

In the method for producing a flame retardant polyester-based fiber of the present invention described above, the amount of the flame-retarder components provided to the polyester-based fiber is not particularly limited. In general, however, the fixed amount (absorbed amount) of the flame-retarder components to the polyester-based fiber is preferably 0.1 to 10% o.w.f. (on weight of fiber), and more preferably 0.5 to 5% o.w.f. If the fixed amount of the flame-retarder components is lower than the above-described lower limit, there arises a tendency that an effect to stably maintain a sufficient flame retardancy is not exhibited. On the other hand, if the fixed amount of the flame-retarder components exceeds the above-described upper limit, deterioration in texture and decrease in fiber strength tends to be problematic, although the effect to stabilize the flame retardancy becomes larger.

Furthermore, in the method for producing a flame retardant polyester-based fiber of the present invention, after the heat treatment step is conducted, soaping treatment is preferably performed on the polyester-based fiber by a generally known method, so that the flame-retarder components which are not fixed to the polyester-based fiber but merely attached on the surface of the polyester-based fiber are removed. As a cleaning agent used in such a soaping treatment, a cleaning agent commonly used in reduction cleaning of a dyed polyester-based fiber can be used, and, for example, anionic, nonionic, and amphoteric surfactants, and a cleaning agent with these surfactant blended therein can be used.

In the method for producing a flame retardant polyester-based fiber of the present invention, a conventionally used different fiber processing agent can also be used in combination with the flame-retarder agent, to such an extent that the flame retardancy is not impaired. Examples of such a fiber processing agent include an antistatic agent, a water and oil repellant, an antifouling agent, a hard finishing agent, a texture modifying agent, a softener, an antibacterial agent, a water absorbent, an anti-slip agent, and a light fastness improving agent.

The flame retardant polyester-based fiber of the present invention includes: the above-mentioned polyester-based fiber; and the above-mentioned flame-retarder components fixed (absorbed) to the polyester-based fiber. In other words, the flame-retarder components are the triphenylphosphine oxide (A), the compound (B) {the organophosphate ester-based compound ($B_1$) and/or the bismaleimide-based compound ($B_2$)}. Such a flame retardant polyester-based fiber has an excellent flame retardancy as well as excellent light fastness and excellent fogging properties.

EXAMPLES

Hereinafter, the present invention will be described more specifically on the basis of Examples and Comparative Examples; however, the present invention is not limited to Examples bellow. Note that the flame retardancy, the light fastness, the haze, and the rubbing fastness of each polyester fiber taken as a sample, as well as the thermal stability and the hydrolysis resistance of each flame-retarder agent taken as a sample are evaluated by the following methods, respectively.

(i) Flame Retardancy Test

The horizontal burning rate of a polyester fiber taken as a sample was measured according to a test method known as the FMVSS-302 method (a test method related to safety standards of interior materials for vehicle).

(ii) Light Fastness Test

A Xenon-arc Weather-Ometer (manufactured by Atlas Material Testing Technology LLC) was used as the testing device. The test was conducted under conditions of an irradiation intensity of 100 W/m$^2$ (300 to 400 nm), a total irradiation intensity of 80 MJ/m$^2$, a black panel temperature of 89° C., and a relative humidity of 50% RH. Note that the polyester fiber taken as the sample was backed with urethane (a urethane foam sheet with a thickness of 10 mm) and then was tested. The class was determined according to the determination method described in JIS L 0804 "grey scale for assessing change in color," and the sample determined as Class 3 or Class with a higher number was rated as acceptable.

(iii) Haze (Fogging) Test

A polyester fiber (with a diameter of 80 mm) placed in a lower part of a container as a sample was heated at 80° C. for 20 hours by using a window screen fogging tester (manufactured by Suga Test Instruments Co., Ltd). The degree to which a glass plate on the top of the container was fogged by the sublimates from the polyester fiber was measured as a haze by using a digital haze computer (manufactured by Suga Test Instruments Co., Ltd), and a polyester fiber with a haze of 10% or less was rated as acceptable.

(iv) Thermal Stability Test

A flame-retarder agent taken as a sample was left, for one week, in a thermostatic bath set at 45° C. The state of the sample was visually observed, and the sample was evaluated on the basis of the following criteria.

A: not changed

B: separated•coagulated substance present

C: solidified (v) Hydrolytic Property Test

A flame-retarder agent (initial pH=7.0) taken as a sample was left for one week in a thermostatic dryer set at 45° C., and the change in pH of the sample was checked, and used as the index of hydrolysis resistance. A sample with significant decrease in pH was evaluated to have low hydrolysis resistance.

(vi) Rubbing Fastness Test

The wet rubbing fastness of a polyester fiber taken as a sample was evaluated according to a test method described in JIS L 0849 (2004) by using a Gakushin-type rubbing tester (manufactured by DAIEI KAGAKU SEIKI MFG. co., ltd). In the evaluation, the degree of stain on a cotton shirting was compared with a gray scale for evaluating stain to evaluate the rubbing fastness on the basis of the following criteria with five Classes.

Class 5: No stain was observed.

Class 4: Slight stain was observed.

Class 3: Apparent stain was observed.

Class 2: Somewhat significant stain was observed.

Class 1: Significant stain was observed.

Examples 1 to 18 and Comparative Examples 1 to 6

Each flame-retarder agent used as a sample was obtained as follows. First, components shown in the corresponding one of Tables 1 to 3 {triphenylphosphine oxide (A), an organophosphate ester-based compound ($B_1$), a bismaleimide-based compounds ($B_2$) and a surfactants (C) and resorcinol diphenyl phosphate in the case of Comparative Example 6} are added into and mixed with water (D) of the blend amount shown in the corresponding table so as to be contained in the blend amounts shown in the corresponding tables, and thus emulsified and dispersed to obtain a flame-retarder agent. (In the tables, the unit of numerical values is "parts by mass," and "-" represents 0 parts by mass.)

Next, a polyester fiber (an undyed fabric of 100% by mass of regular polyester having dope-dyed filling yarns, with a mass per unit area of 400 g/m$^2$) was treated for 30 minutes under the conditions of a liquor ratio of 1:15 and a temperature of 130° C. by using a MINI-COLOUR dyeing machine (manufactured by Texam Co., Ltd.) in a dyeing bath with the following composition:

(i) 3% o.w.f. of a dispersion dye (Dianix Black HLA, manufactured by DyStar Japan Ltd.);

(ii) 0.5 g/L of a dispersing leveling agent (Nicca Sunsalt RM-340E manufactured by NICCA CHEMICAL CO., LTD.);

(iii) 0.5 mL/L of 80 wt % acetic acid; and (iv) 8% o.w.f. of the flame-retarder agent obtained above.

Next, the polyester fiber after the above-described treatment was subjected to a soaping treatment at 80° C. for 20 minutes by using an aqueous solution containing 2 g/L of a soaping agent (ESKUDO FR-7 manufactured by NICCA CHEMICAL CO.), LTD., 1 g/L of sodium sulfate decahydrate, and 1 g/L of hydrosulfite. Then the polyester fiber was dried at 150° C. for 3 minutes to thereby obtain a flame retardant polyester fiber used as the sample.

Comparative Example 7

A polyester fiber used as the sample was obtained as similar to Example 1, except that the (iv) flame-retarder agent was not added to the dyeing bath, and thus no flame-retarder agent was used.

Tables 1 to 3 show evaluation results of the flame retardancy, the light fastness, the haze and the rubbing fastness of each of the polyester fibers taken as the samples, as well as evaluation results of the thermal stability, and the hydrolytic properties of each of the flame-retarder agents taken as the samples.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| A | Triphenylphosphine oxide (*1) | 40 | 40 | 40 | 40 | 40 | 40 | 40 | 40 | 40 |
| $B_2$ | Phenylene bismaleimide (*1) | 2 | 10 | 20 | 10 | 5 | 5 | 10 | 10 | — |
| | 4,4'-diphenylmethane bismaleimide (*1) | — | — | — | — | — | — | — | — | — |
| $B_1$ | Trixylyl phosphate (*1) | — | — | — | 10 | 15 | 25 | — | — | 10 |
| | Tricresyl phosphate (*1) | — | — | — | — | — | — | 10 | — | — |
| | Cresyl diphenyl phosphate (*1) | — | — | — | — | — | — | — | 10 | — |
| C | Polyoxyethylene tristyrenated-phenyl ether phosphate ester (*1) | 2 | 2 | 2 | 2 | 2 | 2 | 2 | 2 | 2 |
| | Polyoxyalkylene tristyrenated-phenyl ether sulfate (*1) | — | — | — | — | — | — | — | — | — |
| D | Water (*1) | 56 | 48 | 38 | 38 | 38 | 28 | 38 | 38 | 48 |
| Flammability [mm/minute] | | 42 | 38 | 41 | 0 | 0 | 0 | 0 | 0 | 12 |
| Light fastness [class] | | 4 | 5 | 5 | 5 | 4 | 3 | 5 | 5 | 4 |
| Haze (Fogging) [HAZE, %] | | 0.9 | 1.2 | 1.3 | 2.2 | 3.5 | 4.8 | 2.6 | 2.5 | 2.1 |
| Thermal stability | | A | A | A | A | A | A | A | A | A |
| Rubbing fastness [class] | | 5 | 5 | 5 | 5 | 4 | 4 | 4 | 5 | 5 |
| Hydrolytic Property Test [pH] | | 7.0 | 7.0 | 7.0 | 6.9 | 6.9 | 6.9 | 6.8 | 6.9 | 6.9 |

(*1): In the tables, the unit of numerical values is "parts by mass," and "—" represents 0 parts by mass.

TABLE 2

| | | Example 10 | Example 11 | Example 12 | Example 13 | Example 14 | Example 15 | Example 16 | Example 17 | Example 18 |
|---|---|---|---|---|---|---|---|---|---|---|
| A | Triphenylphosphine oxide (*1) | 40 | 40 | 40 | 40 | 40 | 30 | 40 | 40 | 40 |
| $B_2$ | Phenylene bismaleimide (*1) | — | — | — | — | 5 | — | 1 | 0.5 | 0.5 |
| | 4,4'-diphenylmethane bismaleimide (*1) | — | — | 10 | 5 | — | — | — | — | — |

TABLE 2-continued

| | | Example 10 | Example 11 | Example 12 | Example 13 | Example 14 | Example 15 | Example 16 | Example 17 | Example 18 |
|---|---|---|---|---|---|---|---|---|---|---|
| $B_1$ | Trixylyl phosphate (*1) | — | — | — | — | 15 | 25 | — | — | — |
| | Tricresyl phosphate (*1) | 10 | — | — | — | — | — | — | — | — |
| | Cresyl diphenyl phosphate (*1) | — | 10 | 10 | — | — | — | — | — | 2 |
| C | Polyoxyethylene tristyrenated-phenyl ether phosphate ester (*1) | 2 | 2 | 2 | 2 | — | 2 | — | — | — |
| | Polyoxyalkylene tristyrenated-phenyl ether sulfate (*1) | — | — | — | — | 2 | — | — | — | — |
| D | Water (*1) | 48 | 48 | 38 | 53 | 38 | 43 | 59 | 59.5 | 57.5 |
| Flammability [mm/minute] | | 0 | 0 | 48 | 53 | 0 | 11 | 57 | 79 | 68 |
| Light fastness [class] | | 4 | 4 | 4 | 4 | 5 | 3 | 4 | 4 | 4 |
| Haze (Fogging) [HAZE, %] | | 2.5 | 2.3 | 2.6 | 1.5 | 3.4 | 5.2 | 1 | 1.4 | 2.1 |
| Thermal stability | | A | A | A | A | B | A | A | A | A |
| Rubbing fastness [class] | | 5 | 5 | 5 | 5 | 4 | 4 | 5 | 5 | 5 |
| Hydrolytic Property Test [pH] | | 6.8 | 6.9 | 7.0 | 7.0 | 7.0 | 6.9 | 7.0 | 7.0 | 7.0 |

(*1): In the tables, the unit of numerical values is "parts by mass," and "—" represents 0 parts by mass.

TABLE 3

| | | Comparative Example 1 | Comparative Example 2 | Comparative Example 3 | Comparative Example 4 | Comparative Example 5 | Comparat i ve Example 6 | Comparative Example 7 |
|---|---|---|---|---|---|---|---|---|
| A | Triphenylphosphine oxide (*1) | 40 | — | — | — | — | — | — |
| $B_2$ | Phenylene bismaleimide (*1) | — | 40 | — | — | — | — | — |
| | 4,4'-diphenylmethane bismaleimide (*1) | — | — | — | — | — | — | — |
| $B_1$ | Trixylyl phosphate (*1) | — | — | 40 | — | — | — | — |
| | Tricresyl phosphate (*1) | — | — | — | 40 | — | — | — |
| | Cresyl diphenyl phosphate (*1) | — | — | — | — | 40 | — | — |
| — | Resorcinol diphenyl phosphate (*1) | — | — | — | — | — | 40 | — |
| C | Polyoxyethylene tristyrenated-phenyl ether phosphate ester (*1) | — | — | — | — | — | — | — |
| | Polyoxyalkylene tristyrenated-phenyl ether sulfate (*1) | — | — | — | — | — | — | — |
| D | Water (*1) | 60 | 60 | 60 | 60 | 60 | 60 | 100 |
| Flammability [mm/minute] | | 90 | 148 | 84 | 78 | 75 | 66 | 165 |
| Light fastness [class] | | 4 | 5 | 2 | 2 | 2 | 4 | 5 |
| Haze (Fogging) [HAZE, %] | | 1.1 | 0.2 | 10.5 | 14.3 | 15.6 | 3.5 | 0.8 |
| Thermal stability | | A | A | A | A | A | C | — |
| Rubbing fastness [class] | | 5 | 5 | 3 | 3 | 3 | 2 | 5 |
| Hydrolytic Property Test [pH] | | 6.9 | 7.0 | 6.9 | 6.8 | 6.9 | 2.8 | — |

(*1): In the tables, the unit of numerical values is "parts by mass," and "—" represents 0 parts by mass.

As apparent from the results shown in Table 1 to Table 3, it was found that, when the flame-retarder agents of the present invention each containing triphenylphosphine oxide (A) and the organophosphate ester-based compound ($B_1$) and/or the bismaleimide-based compound ($B_2$) was used (Examples 1 to 18), the obtained flame-retarder agents were excellent in thermal stability and hydrolysis resistance. It was also found that the polyester fibers obtained by using these flame-retarder agents were excellent in flame retardancy, light fastness, anti-fogging properties and rubbing fastness.

In contrast, it was found that, when only triphenylphosphine oxide (A) was used (Comparative Example 1) and when only the bismaleimide-based compound ($B_2$) was used (Comparative Example 2), the obtained polyester fibers were inferior in flame retardancy.

In addition, it was found that, when only an organophosphate ester-based compound ($B_1$) was used (Comparative Examples 3 to 5), the obtained polyester fibers had lowered flame retardancy as well as inferior light fastness and inferior anti-fogging properties.

Furthermore, when resorcinol diphenyl phosphate was used as the organophosphate ester-based compound (Comparative Example 6), the obtained polyester fiber had inferior rubbing fastness, and the flame-retarder agent was also inferior in thermal stability and hydrolysis resistance.

INDUSTRIAL APPLICABILITY

As has been described above, the present invention makes it possible to provide a phosphorus flame-retarder agent which is capable of providing an excellent flame retardancy to a polyester-based fiber while adverse impacts on light fastness, rubbing fastness and fogging properties (haze properties) are sufficiently prevented, and which is excellent in thermal stability and hydrolysis resistance, and also to provide a polyester-based fiber having an excellent flame retardancy and a method for producing the polyester-based fiber.

Accordingly, the polyester-based fiber of the present invention obtained by using the flame-retarder agent for a polyester-based fiber of the present invention has excellent light fastness, rubbing fastness, and anti-fogging properties as well as an excellent flame retardancy, and thus can be used in various fields of clothing and other materials. In particular, in the field of interior materials for vehicle, such as a vehicular seat, polyester-based fibers need to have not only flame retardancy but also excellent texture and anti-fogging properties and to exhibit fewer decrease in light fastness and rubbing fastness. The flame retardant polyester-based fiber of the present invention obtained by using the flame-retarder agent for a polyester-based fiber of the present invention is useful especially in such a field.

The invention claimed is:

1. A flame-retarder agent for a polyester-based fiber comprising, as flame-retarder components:

triphenylphosphine oxide (A) represented by the following formula (1):

(1)

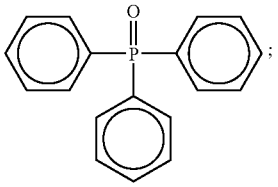

and at least one compound (B) selected from the group consisting of an organophosphate ester-based compound ($B_1$) and a bismaleimide-based compound ($B_2$), the organophosphate ester-based compound ($B_1$) being represented by the following general formula (2):

(2)

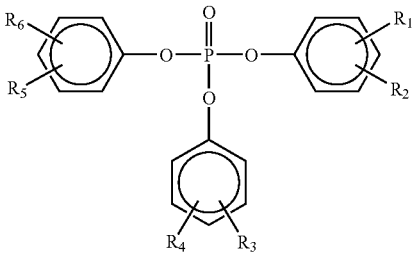

in formula (2), $R_1$ to $R_6$ are the same or different, and each represent one selected from the group consisting of a hydrogen atom and an alkyl group having 1 to 4 carbon atoms, the bismaleimide-based compound (B2) being represented by the following general formula (3):

(3)

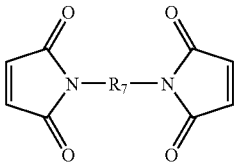

in formula (3), $R_7$ represents an arylene group having 6 to 20 carbon atoms, wherein a ratio (A:B) by mass of the triphenylphosphine oxide (A) to the compound (b) is 1:0.05 to 1:0.8.

2. The flame-retarder agent for a polyester-based fiber according to the claim 1, wherein the organophosphate ester-based compound (B1) is cresyl diphenyl phosphate.

3. The flame-retarder agent for a polyester-based fiber according to the claim 1, wherein the bismaleimide-based compound (B2) is phenylene bismaleimide.

4. The flame-retarder agent for a polyester-based fiber according to the claim 1, wherein the triphenylphosphine oxide (A) and the compound (B) are emulsified or dispersed in water (D) by a surfactant (C).

5. The flame-retarder agent for a polyester-based fiber according to the claim 4, wherein the surfactant (C) is a phosphate ester anionic surfactant.

6. A method for producing a flame retardant polyester-based fiber comprising the steps of:

bringing a flame-retarder agent into contact with a polyester-based fiber, wherein the flame-retarder agent comprises, as flameretarder components, triphenylphosphine oxide (A) represented by the following formula (1):

(1)

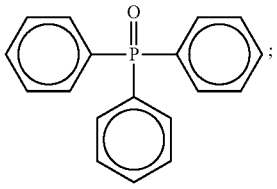

and at least one compound (B) selected from the group consisting of an organophosphate ester-based compound ($B_1$) and a bismaleimide-based compound ($B_2$), the organophosphate ester-based compound ($B_1$) being represented by the following general formula (2):

(2)

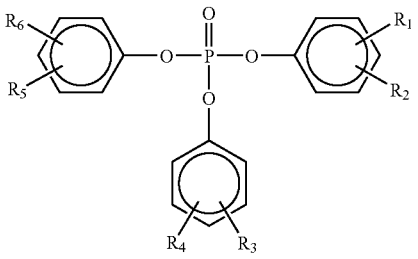

in formula (2), $R_1$ to $R_6$ are the same or different, and each represent one selected from the group consisting of a hydrogen atom and an alkyl group having 1 to 4 carbon atoms, the bismaleimide-based compound (B2) being represented by the following general formula (3):

(3)

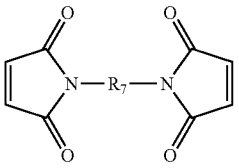

in formula (3), $R_7$ represents an arylene group having 6 to 20 carbon atoms; and fixing the triphenylphosphine oxide (A) and the compound (B) to the polyester-based fiber by heating.

7. A flame retardant polyester-based fiber comprising:

a polyester-based fiber; and triphenylphosphine oxide (A) and at least one compound (B) which are fixed to the polyester-based fiber as flame-retarder components, the triphenylphosphine oxide (A) being represented by the following formula (1):

(1)

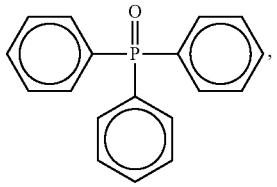

the at least one compound (B) being selected from the group consisting of an organophosphate ester-based compound (B1) and a bismaleimide-based compound (B2), the organo phosphate ester-based compound (B1) being represented by the following general formula (2):

(2)

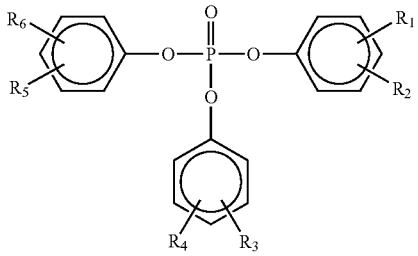

in formula (2), R1 to R6 are the same or different, and each represent one selected from the group consisting of a hydrogen atom and an alkyl group having 1 to 4 carbon atoms and the bismaleimide-based compound (B2) being represented by the following general formula (3):

(3)

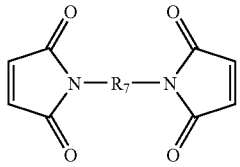

in formula (3), R7 represents an arylene group having 6 to 20 carbon atoms.

8. A method according to claim 6, wherein a ratio (A:B) by mass of the triphenylphosphine oxide (A) to the compound (B) is 1:0.05 to 1:0.8.

* * * * *